US007402987B2

(12) United States Patent
Lopata

(10) Patent No.: US 7,402,987 B2
(45) Date of Patent: Jul. 22, 2008

(54) LOW-DROPOUT REGULATOR WITH STARTUP OVERSHOOT CONTROL

(75) Inventor: Douglas D. Lopata, Boyertown, PA (US)

(73) Assignee: Agere Systems Inc., Allentown, PA (US)

( * ) Notice: Subject to any disclaimer, the term of this patent is extended or adjusted under 35 U.S.C. 154(b) by 237 days.

(21) Appl. No.: 11/186,231

(22) Filed: Jul. 21, 2005

(65) Prior Publication Data

US 2007/0018623 A1 Jan. 25, 2007

(51) Int. Cl.
*G05F 1/00* (2006.01)

(52) U.S. Cl. ..... 323/282; 323/280

(58) Field of Classification Search ..... 323/282, 323/280, 284, 351, 226, 273, 312, 253; 327/540, 327/538

See application file for complete search history.

(56) References Cited

U.S. PATENT DOCUMENTS

| | | | | |
|---|---|---|---|---|
| 4,543,522 A | 9/1985 | Moreau | 323/303 |
| 5,038,310 A * | 8/1991 | Akagiri et al. | 708/205 |
| 5,929,696 A * | 7/1999 | Lim et al. | 327/540 |
| 6,163,285 A | 12/2000 | Lopata | 341/118 |
| 6,388,433 B2 | 5/2002 | Marty | 323/284 |
| 6,703,816 B2 | 3/2004 | Biagi et al. | 323/280 |
| 6,856,124 B2 | 2/2005 | Dearn et al. | 323/280 |
| 6,870,423 B2 * | 3/2005 | Takauchi et al. | 330/253 |
| 2003/0042971 A1 * | 3/2003 | Oikawa et al. | 327/540 |
| 2003/0090251 A1 * | 5/2003 | Nakashimo | 323/280 |

OTHER PUBLICATIONS

Kularatna et al., Shunt Regulator Design Enhances LDO Reliability, Power Electronics Technology, May 2005, pp. 32-38.
Chester Simpson, Linear Regulators: Theory of Operation and Compensation, 2002 National Semiconductor Corporation May 2000, pp. 1-8.
Lei et al., Low Dropout 3.0 Volt Linear Regulator, Supertex Inc., Nov. 12, 2001, pp. 1-4.
Adjustable Voltage Regulator 1C TK11100CS, Application Manual, TOKO, Jul. 2004, pp. 1-25.

* cited by examiner

*Primary Examiner*—Matthew V Nguyen
*Assistant Examiner*—Nguyen Tran

(57) ABSTRACT

The present invention provides an LDO regulator having a greatly improved overshoot characteristic through the use of an output voltage based feedback loop. More specifically, in the invention, one or more resistors in the divider network in a conventional LDO regulator is replaced with a variable resistor. By varying the resistance of the variable resistor as a function of the output voltage of the LDO regulator, the closed-loop gain of the LDO amplifier may be modulated in such a way as to reduce overshoot in the output voltage of the LDO regulator. In particular, the targeted final output voltage value may be arbitrarily lowered for a predetermined period of time, so that the LDO regulator output may rapidly reach a steady state voltage that is very close to the final desired regulating value without exceeding the final desired regulating value during regulator startup.

9 Claims, 1 Drawing Sheet

LOW-DROPOUT REGULATOR WITH STARTUP OVERSHOOT CONTROL

FIELD OF THE INVENTION

The present invention relates generally to voltage regulators, and more particularly to low drop-out (LDO) linear voltage regulators.

BACKGROUND OF THE INVENTION

Low drop-out (LDO) type linear voltage regulators are used in a variety of applications. In particular, these regulators may be used in mobile telephones to deliver a regulated voltage from a battery power supply voltage to radio transmitter and receiver circuits.

By way of example, a standard linear regulator 100 is illustrated in FIG. 1. An output of the regulator 100 delivers a regulated voltage $V_{OUT}$ to a load Z (not shown). The load Z represents, for example, radio circuits present in a mobile telephone. The regulator 100 is powered by a voltage $V_{IN}$ delivered by a battery or other supply source. The regulator 100 comprises a differential amplifier 110 whose output drives the gate of a P-channel metal oxide semiconductor (PMOS) transistor Q1 having a threshold voltage $V_{TP}$. The output stage of the amplifier 110 has an output resistance Ro that determines the gain of the amplifier 110 and the maximum current that it can deliver at its output.

The transistor Q1 receives the voltage $V_{IN}$ at its input terminal (source). Its output terminal (drain) is connected to node 120, which is the output of the regulator 100. Node 120 also is connected to the anode of a capacitor $C_{BYP}$ (having parasitic resistance RESR) for filtering and stabilizing the voltage $V_{OUT}$. Capacitor $C_{BYP}$ (with parasitic resistance RESR) is parallel-connected with the load Z. The amplifier 110 receives a reference voltage $V_{REF}$ at its inverting input and a feedback voltage $V_{FB}$ at its non-inverting input. The voltage $V_{FB}$ is, for example, a fraction of the voltage $V_{OUT}$ provided to the input of the amplifier 110 by a divider bridge including two resistors R2, R1.

Operation of a regulator of this kind, which is well known to those skilled in the art, includes modulating the control voltage (gate voltage Vg) of the transistor Q1 using the amplifier 110. This is done as a function of the difference between the voltage $V_{FB}$ and the reference voltage $V_{REF}$. When the voltage Vg is substantially smaller than $V_{IN}-V_{TP}$, the transistor Q1 is on because its gate-source voltage Vgs is substantially higher than the threshold voltage $V_{TP}$. When the voltage Vg is higher than $V_{IN}-V_{TP}$, the transistor Q1 is off. In a stabilized state, the voltage $V_{OUT}$ is regulated in the neighborhood of its nominal valve $V_{OUT,NOM}$, which is equal to $[(R2+R1)\,V_{REF}/R1]$.

The conventional regulator 100 of FIG. 1, however, suffers from an undesirable overshoot phenomenon for two main reasons. First, in an application such as supplying a regulated supply to radio circuits of a mobile telephone, it is important that the amplifier 110 consume as little power as possible to maintain the charge stored in the battery. To this end, the bias current of the amplifier should be as low as possible, limiting the speed and bandwidth of the amplifier. Second, the regulation transistor Q1 must have a low series resistance $R_{dsON}$ in the "on" state (drain-source resistance) so that it can deliver high current without any prohibitive voltage dropout at its terminals. Thus, the transistor Q1 conventionally has a high gate width-to-length ratio. Due to its size and its high W/L ratio, the transistor Q1 also has a high gate capacitance Cg (not shown) between gate and drain. The combination of these two factors tends to make the LDO regulator slow to respond to transients.

While these various characteristics are desirable to obtain a regulator with low power consumption and low voltage dropout, driving a regulation transistor that has high gate capacitance Cg with an amplifier with a limited maximum output current causes an undesirable overshooting phenomena, in certain conditions, at the output of the regulator. For example, during startup, the bandwidth of the regulator can be too low to sufficiently stop high-current startup transients (300-400 mAmps or more) from creating voltage overshoot at the output of the regulator. A target voltage of 1.8 V, for example, can be overshot by as much as 100-200 mV. Large overshoot voltages such as these can take a long time to settle, because most conventional regulators are designed without a large current sink capability. As a result, when load currents are light, the output voltage overshoot can overstress the integrated circuit components supplied by the regulator for extended periods of time. Since these devices are often implemented in low voltage processes, these sensitive devices can be overstressed for significant periods of time by the overshoot voltage and potentially be permanently damaged. The overshoot can also force these sensitive circuits outside their simulated and guaranteed operating ranges, causing errors in device operation to occur.

SUMMARY OF THE INVENTION

The present invention provides an LDO regulator having a greatly improved overshoot characteristic through the use of an output-voltage based feedback loop. More specifically, in the invention, one of the resistors in the divider network is replaced with a variable resistor. By varying the resistance of the variable resistor as a function of the output voltage of the LDO regulator, the closed-loop gain of the LDO amplifier may be modulated in such a way as to reduce startup overshoot in the output voltage of the LDO regulator. In particular, the targeted final output voltage value may be arbitrarily lowered for a short, predetermined period of time, so that during startup the LDO regulator output rapidly reaches a steady state that is very close to the final desired regulating value.

Thus, in a first aspect, the present invention is a voltage regulator for converting a supply voltage to a regulated output voltage based on a reference voltage, comprising: (i) a transistor having an input terminal for receiving the supply voltage, an output terminal for outputting the regulated output voltage, and a transistor control terminal; (ii) a voltage divider connected to the output terminal of the transistor and having a feedback terminal for outputting a feedback voltage based on the regulated output voltage, the voltage divider including at least one variable resistor having a resistance control terminal for receiving a resistance control signal; and (iii) a differential amplifier having a first input terminal for receiving the reference voltage, a second input terminal connected to the feedback terminal of the variable resistance, and an output terminal connected to the transistor control terminal, whereby the voltage at the output terminal of the transistor may be adjusted as a function of the resistance control signal. The voltage regulator preferably further comprises a feedback circuit connected between the transistor's output terminal and the resistance control terminal of the variable-resistance network, whereby the resistance of the variable-resistance network may be varied based on the regulated output voltage at the output terminal of the transistor.

In a second aspect, the invention provides a method and means for converting a supply voltage to a regulated output voltage based on a reference voltage via a regulation transistor having an input terminal, an output terminal, and a control terminal, comprising the steps of: inputting the supply voltage to the input terminal of the transistor; feeding back the voltage at the output terminal of the transistor through a variable resistor to produce a feedback voltage; producing a control voltage based on the feedback voltage and the reference voltage; inputting the control voltage to the control terminal of the transistor; and outputting the voltage at the output terminal of the transistor as the regulated output voltage.

In a third aspect, the invention provides a method and means for converting a supply voltage to a predetermined regulated voltage via a voltage regulator, comprising the steps of: setting a target output voltage to a first target voltage that is less than the predetermined regulated voltage; ramping an output voltage of the voltage regulator toward the target output voltage; subsequently setting the target output voltage to a second target voltage that is the predetermined final output voltage; and ramping the output voltage of the voltage regulator toward the second target voltage, whereby a tendency of the voltage regulator to overshoot the predetermined final output voltage is reduced.

BRIEF DESCRIPTION OF THE DRAWINGS

Various embodiments of the present invention will now be described in detail in conjunction with the annexed drawings, in which.

DETAILED DESCRIPTION

Figure 1:
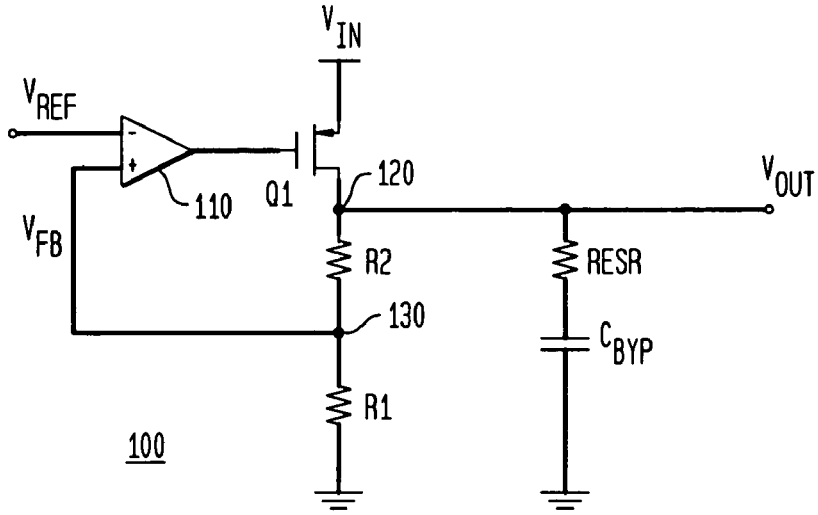
FIG. 1 (PRIOR ART)
FIG. 1 is a schematic diagram of a voltage regulator according to the prior art.
Figure 2:
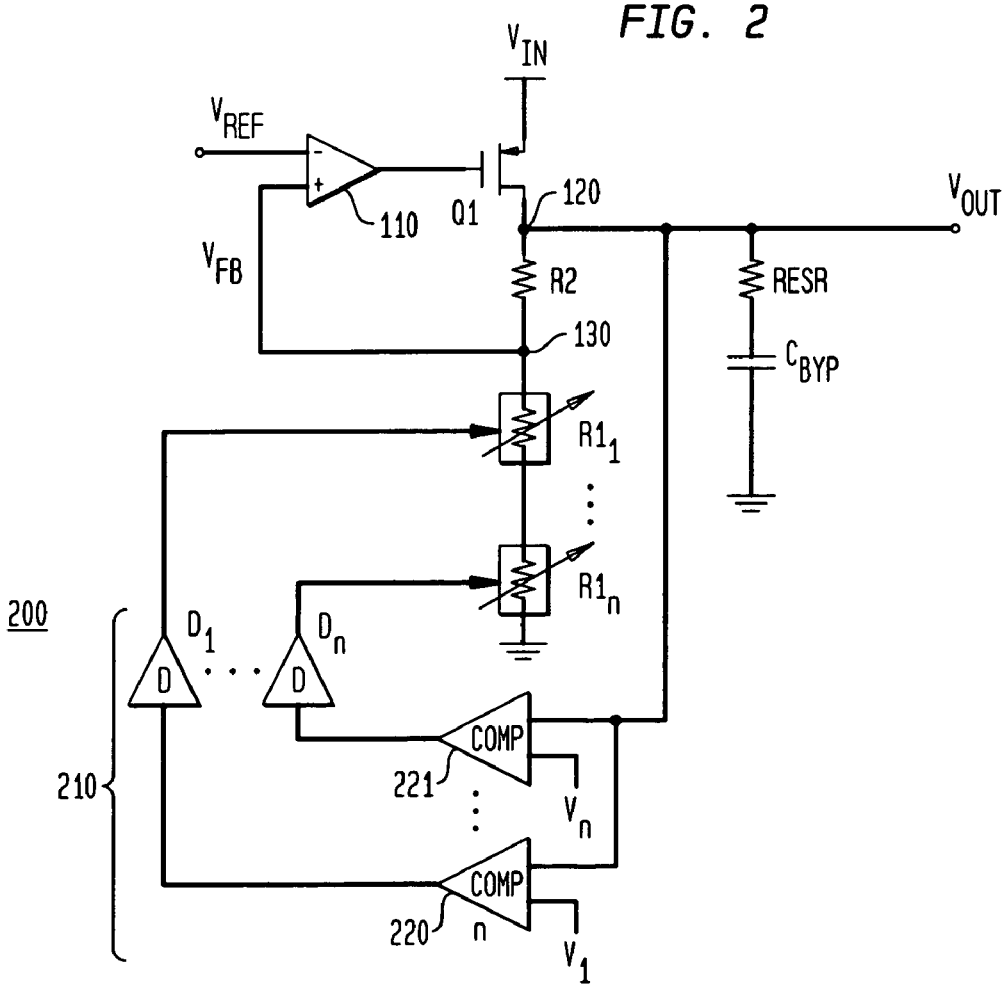
FIG. 2 is a schematic diagram of a voltage regulator having overshoot control according to the invention.

Turning now to FIG. 2, a regulator 200 according to the invention is supplied with a voltage $V_{IN}$ provided, e.g., by a battery or other voltage source (not shown). The regulator 200, like that illustrated in FIG. 1, includes a differential amplifier 110 whose output controls the gate of a PMOS regulation transistor Q1. The output terminal (drain) of the transistor Q1 is connected, at the output of the regulator 200, to a stabilizing capacitor $C_{BYP}$ (and associated parasitic resistance RESR) parallel-connected with the load Z. These various elements are laid out as described above and are designated by the same references. The output voltage $V_{OUT}$ is brought to the positive input of the amplifier 110 by a divider bridge including a fixed resistor R2 and one or more variable resistors $R1_1$ through $R1_n$. The one or more variable resistors $R1_1$ through $R1_n$ are preferably voltage-controlled resistive elements (not shown) of conventional design, e.g., NMOS transistors that are designed to have variable resistance.

As in the regulator described above, the relationship between the output voltage $V_{OUT}$ and the feedback voltage $V_{FB}$ is $[V_{OUT}=(R2+(R1_1+R1_n))V_{FB}/(R1_1+R1_n)]$. The reference voltage $V_{REF}$ applied to the negative input of the amplifier 110 is, for example, a voltage known as a bandgap voltage having high stability as a function of temperature. The reference voltage $V_{REF}$ may be generated, e.g., by PN junction diodes and current mirrors, in a manner known in the art, so that the voltage $V_{REF}$ is independent of the voltage $V_{IN}$.

The working of the regulator 200 in a continuous state conforms to that of the conventional regulator 100 described above. In essence, the amplifier 110 keeps the feedback voltage $V_{FB}$ at a level equal to the reference voltage $V_{REF}$ and the nominal output voltage $V_{OUT,NOM}$ is equal to $[(R2+(R1_1+R1_n))V_{FB}/(R1_1+R1_n)]$.

In accordance with the invention, regulator 200 further includes a feedback circuit 210 connected between the output $V_{OUT}$ of the regulator 200 and the control terminals of the variable resistors $R1_1$ through $R1_n$, respectively. In the embodiment shown in FIG. 2, the feedback circuit 210 includes one to n comparators 220, 221 that receive as inputs the voltage $V_{OUT}$ of the regulator 200 and a predetermined setpoint voltage $V_1$ through $V_n$, respectively. The outputs of the one to n comparators 220, 221 are connected respectively to the control terminals of the variable resistors $R1_1$ through $R1_n$ through delay elements $D_1$ through $D_n$. Thus, each of the one to n comparators 220, 221 is associated, and controls the resistance of, a respective one of the variable resistors $R1_1$ through $R1_n$.

When the output voltage $V_{OUT}$ of regulator 200 is below a predetermined setpoint value selected for each comparator (i.e., the respective setpoint voltage $V_1$ through $V_n$), the respective comparator modulates the resistance of the associated variable resistor. By modulating the resistance of variable resistors $R1_1$ through $R1_n$, the comparators 220, 221 adjust the closed-loop gain of the feedback loop formed by transistor Q1, the voltage divider including variable resistors $R1_1$ through $R1_n$, and resistor R2, and the differential amplifier 110. This feedback gain in turn determines a target voltage value $V_{OUT,TARGET}$. Thus, by modulating the resistances of the variable resistors $R1_1$ through $R1_n$, the target voltage value $V_{OUT,TARGET}$ of the regulator 200 is shifted up or down based on the output voltage $V_{OUT}$ of regulator 200. The resulting on-the-fly shifting of the target voltage value $V_{OUT,TARGET}$ provides a feedback condition that tends to reduce or even entirely eliminate voltage overshoot in the output of regulator 200 when the regulator is starting up from $V_{OUT}=0$, or when the regulator output is far from targeted final value.

Thus, the target output voltage may initially be set to a first target voltage that is less than the desired regulated voltage (e.g., 2-3% of the final voltage). The output voltage of the voltage regulator thus ramps up toward the target output voltage. Subsequently, as the output voltage reaches a desired setpoint or setpoints (determined by setpoint voltages $V_1$ through $V_n$), the comparators modulate the resistance of the resistors and thereby set the target output voltage to a second target voltage that is the predetermined final output voltage. Finally, the output voltage of the voltage regulator ramps toward the second target voltage. In other words, the regulator 200 is capable of starting up at full speed, settling at a predetermined target value close to but less than the desired final value, and then slewing up to the desired final value $V_{OUT}$ after the regulator has entered into a settled steady-state condition close to the final desired value, thereby reducing the tendency of the voltage regulator to overshoot the predetermined final output voltage.

Delay elements $D_1$ through $D_n$ preferably provide a predetermined amount of delay between the output of comparators 220 and 221 and the control terminals of variable resistors $R1_1$ through $R1_n$. With the inclusion of delay elements $D_1$ through $D_n$, a short delay will occur after the output voltage of the regulator 200 reaches the setpoint or setpoints of the comparators 220, 221, before the target output voltage is set to the second predetermined target voltage. The delays associated with delay elements $D_1$ through $D_n$ allow the startup characteristics of a given regulator to be designed and adjusted for a given application. With a greater delay, the overshoot will tend to be smaller, but the the settling time will be longer.

Comparators 220, 221 preferably also include a substantial hysteresis effect, in order to prevent false triggering in situations where output voltages fall, e.g., as a result of small load transients).

It will be recognized that the target voltage of the voltage regulator may be controlled in an analog or digital fashion by varying resistances of variable resistors $R1_1$ through $R1_n$ accordingly. For example, in the embodiment depicted in FIG. 2, the comparators are digital or binary devices that set the target voltage to a first predetermined target voltage while the output voltage is less than the predetermined setpoint voltage, and set the target voltage to a second predetermined target voltage while the output voltage is greater than the predetermined setpoint voltage. In an alternative embodiment, comparators 220, 221 may be differential amplifiers that continuously vary the resistances of variable resistors $R1_1$ through $R1_n$, based on the output voltage of regulator 200. Thus, the term, "comparator" as used herein is intended to include both digital comparators and analog differential amplifiers.

The present invention may further be described as a method for converting a supply voltage to a regulated output voltage based on a reference voltage via a regulation transistor having an input terminal, an output terminal, and a control terminal. The method comprises the steps of: inputting the supply voltage to the input terminal of the transistor; feeding back the voltage at the output terminal of the transistor through a voltage divider including at least one variable resistor to produce a feedback voltage; producing a control voltage based on the feedback voltage and the reference voltage; inputting the control voltage to the control terminal of the transistor; and outputting the voltage at the output terminal of the transistor as the regulated output voltage. The method may further comprise the step of amplifying the difference between the feedback voltage and the reference voltage, and the step of adjusting the resistance of the at least one variable resistor based on the voltage at the output terminal of the transistor. The step of adjusting may comprise the steps of: comparing the voltage at the output terminal of the transistor with a predetermined setpoint voltage to produce a comparison signal; and inputting the comparison signal to a control terminal of the at least one variable resistor. The step of adjusting the resistance of the at least one variable resistor may also comprise the step of delaying the comparison signal by a predetermined delay time. The invention further provides means corresponding to the above method for converting a supply voltage to a regulated output voltage based on a reference voltage via a regulation transistor.

The invention may additionally be described as a method for converting a supply voltage to a predetermined regulated voltage via a voltage regulator, comprising the steps of: setting a target output voltage to a first target voltage that is less than the predetermined regulated voltage; ramping an output voltage of the voltage regulator toward the target output voltage; subsequently setting the target output voltage to a second target voltage that is the predetermined final output voltage; and ramping the output voltage of the voltage regulator toward the second target voltage, whereby a tendency of the voltage regulator to overshoot the predetermined final output voltage is reduced. The method may further comprise the step of comparing the output voltage of the voltage regulator with a predetermined comparison voltage, wherein the step of setting the target output voltage to the first target voltage is performed while the output voltage is greater than the predetermined comparison voltage, and wherein the step of setting the target output voltage to the second target voltage is performed while the output voltage is less than the predetermined comparison voltage. The step of setting the target output voltage to a first target voltage may includes the step of adjusting the resistance of a variable resistor to a value corresponding to the first target voltage; and the step of setting the target output voltage to a second target voltage includes the step of adjusting the resistance of the variable resistor to a value corresponding to the second target voltage. The method may further comprise the step of delaying by a predetermined time period before setting the target output voltage to the second target voltage. The invention further provides means corresponding to the above method for converting a supply voltage to a predetermined regulated voltage via a voltage regulator The invention as described above has several significant advantages over conventional LDO regulators and regulation techniques. First, the adjustable gain provided by the variable resistance network serves to reduce regulator overshoot during startup, while still rapidly bringing the regulated output voltage to about 2-3% of the final voltage value. Because the regulated voltage rises rapidly to close to the final voltage value without a large overshoot voltage, the regulator of the present invention reaches a stable output voltage suitable for powering load devices much more quickly than conventional LDO regulators that suffer from significant overshoot. This method also protects the load devices from overshoot damage or operation outside of a specified supply range. Moreover, the additional closed-loop feedback adjustment components in the present invention require only a small portion of the overall die area required by the regulator, and may therefore be implemented at a very low incremental cost in comparison with conventional regulators.

It should be understood that, although the present invention has been described above in connection with a P-type MOSFET regulation transistor, it is not limited to use with p-type transistors or with MOSFET technology. Rather, the teaching explained above in connection with the present invention can also be applied to the making of a regulator with an NMOS type series transistor, or with other transistor technologies relating to bipolar junction transistors, JFETs, etc.

It should further be recognized that the present invention is compatible with, and may be used in conjunction with, conventional compensation circuits commonly employed in LDO regulators for lead/lag compensation. Finally, it should be understood that the foregoing description of the invention is by way of example only, and variations will be evident to those skilled in the art without departing from the scope of the invention, which is as set out in the appended claims.

What is claimed is:

1. A method of converting a supply voltage to a predetermined regulated voltage via a voltage regulator, comprising the steps of:

setting a target output voltage to a first target voltage that is less than the predetermined regulated voltage;

ramping an output voltage of the voltage regulator toward the target output voltage;

subsequently setting the target output voltage to a second target voltage that is the predetermined final output voltage; and ramping the output voltage of the voltage regulator toward the second target voltage;

whereby a tendency of the voltage regulator to overshoot the predetermined final output voltage is reduced.

2. The method of claim 1, further comprising the step of:

comparing the output voltage of the voltage regulator with a predetermined comparison voltage, wherein the step of setting the target output voltage to the first target voltage is performed while the output voltage is greater than the predetermined comparison voltage, and wherein the step of setting the target output voltage to the second target voltage is performed while the output voltage is less than the predetermined comparison voltage.

3. The method of claim 1, wherein the step of setting the target output voltage to a first target voltage includes the step of adjusting the resistance of a variable resistor to a value corresponding to the first target voltage; and wherein the step of setting the target output voltage to a second target voltage includes the step of adjusting the resistance of the variable resistor to a value corresponding to the second target voltage.

4. The method of claim 1, further comprising the step of:

delaying by a predetermined time period before setting the target output voltage to the second target voltage.

5. The method of claim 1, wherein the voltage regulator is a low-drop-out regulator.

6. An apparatus for producing, from a supply voltage, an output voltage that is a predetermined regulated voltage, comprising:

means for setting a target output voltage to a first target voltage that is less than the predetermined regulated voltage;

means for ramping the output voltage toward the target output voltage;

means for subsequently setting the target output voltage to a second target voltage that is the predetermined final output voltage; and means for ramping the output voltage toward the second target voltage; whereby a tendency of the apparatus to overshoot the predetermined final output voltage is reduced.

7. The apparatus of claim 6, further comprising:

means for comparing the output voltage with a predetermined comparison voltage, wherein the means for setting the target output voltage to the first target voltage is operative while the output voltage is greater than the predetermined comparison voltage, and wherein the means for setting the target output voltage to the second target voltage is operative while the output voltage is less than the predetermined comparison voltage.

8. The apparatus of claim 6, wherein the means for setting the target output voltage to a first target voltage includes a means for adjusting the resistance of a variable resistor to a value corresponding to the first target voltage; and wherein the means for setting the target output voltage to a second target voltage includes a means for adjusting the resistance of the variable resistor to a value corresponding to the second target voltage.

9. The apparatus of claim 6, further comprising:

means for delaying by a predetermined time period before the target output voltage is set to the second target voltage.

* * * * *